US007332835B1

(12) United States Patent
Wright et al.

(10) Patent No.: US 7,332,835 B1
(45) Date of Patent: Feb. 19, 2008

(54) MICRO-ELECTROMECHANICAL SYSTEM BASED SWITCHING MODULE SERIALLY STACKABLE WITH OTHER SUCH MODULES TO MEET A VOLTAGE RATING

(75) Inventors: Joshua Isaac Wright, Arlington, VA (US); Kanakasabapathi Subramanian, Clifton Park, NY (US); William James Premerlani, Scotia, NY (US); John Norton Park, Rexford, NY (US); Kuna Venkat Satya Rama Kishore, Bangalore (IN)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 11/563,774

(22) Filed: Nov. 28, 2006

(51) Int. Cl.
*H01H 57/00* (2006.01)
*H01H 47/02* (2006.01)

(52) U.S. Cl. ..... 307/134; 200/600; 307/77; 361/207

(58) Field of Classification Search ..... 200/600; 307/69, 77, 82, 134; 361/207
See application file for complete search history.

(56) References Cited

U.S. PATENT DOCUMENTS 7,190,092 B2 * 3/2007 Ivanciw et al. ..... 307/134
7,218,499 B2 * 5/2007 Martin et al. ..... 361/207

* cited by examiner

*Primary Examiner*—Gary L Laxton
(74) *Attorney, Agent, or Firm*—Jason K. Klindtworth; Curtis B. Brueske

(57) ABSTRACT

MEMS-based switching module, as may be electrically connected to other such modules in a series circuit, to achieve a desired voltage rating is provided. A switching array may be made up of a plurality of such switching modules (e.g., used as building blocks of the switching array) with circuitry configured so that any number of modules can be connected in series to achieve the desired voltage rating (e.g., voltage scalability).

18 Claims, 5 Drawing Sheets

MICRO-ELECTROMECHANICAL SYSTEM BASED SWITCHING MODULE SERIALLY STACKABLE WITH OTHER SUCH MODULES TO MEET A VOLTAGE RATING

FIELD OF THE INVENTION

Embodiments of the present invention relate generally to a switching device for selectively switching a current in a current path, and more particularly to switching devices based on micro-electromechanical systems (MEMS), an even more particularly to an array of MEMS-based switching modules as may be connected in a series circuit to achieve a desired voltage rating.

BACKGROUND OF THE INVENTION

It is known to connect MEMS switches to form a switching array, such as series connected modules of parallel switches, and parallel connected modules of series switches. An array of switches may be needed because a single MEMS switch may not be capable of either conducting enough current, and/or holding off enough voltage, as may be required in a given switching application.

An important property of such switching arrays is the way in which each of the switches contributes to the overall voltage and current rating of the array. Ideally, the current rating of the array should be equal to the current rating of a single switch times the number of parallel branches of switches, for any number of parallel branches. Such an array would be said to be current scaleable. Current scaling has been achieved in practical switching arrays but voltage scaling has not.

In concept, the voltage rating of the array should be equal to the voltage rating of a single switch times the number of switches in series. However, achieving voltage scaling in practical switching arrays has presented difficulties. For instance, in known switching arrays for a given voltage rating of a switching module, it is not possible to continue to increment the number of switching modules that may be connected in series to achieve any desired voltage rating. This is due to the fact that the voltage rating of the circuitry in a respective switching module will eventually be exceeded due to relatively large voltage levels that can develop across the open switches. Thus, known switching arrays are limited in the number of switches that can be interconnected in series, and consequently lack the ability to provide voltage scalability.

BRIEF DESCRIPTION OF THE INVENTION

Generally, aspects of the present invention fulfill the foregoing needs by providing in one example embodiment a system comprising at least one switching module. Other such modules may be used as building blocks of a switching array configured so that any number of modules can be connected in a series circuit to achieve a desired voltage rating (e.g., voltage scalability). The switching module includes switching circuitry comprising at least one micro-electromechanical system switch for selectively establishing a current path from an input line to an output line of the switch in response to a gate control signal applied to the switch. The switching module further includes control circuitry coupled to the switching circuitry to supply the gate control signal to the micro-electromechanical system switch, and power circuitry coupled to the control circuitry and the switching circuitry. The power circuitry provides an input terminal pair and an output terminal pair galvanically isolated from one another, wherein a module power input signal received through the input terminal pair is electrically referenced to the input line of the switch, and a module power output signal supplied through the output terminal pair is electrically referenced to the output line of the switch so that the module output power signal is unaffected by a voltage that develops across the input and output lines of the micro-electromechanical system switch when the switch is set to an open state.

BRIEF DESCRIPTION OF THE DRAWINGS

The invention is explained in the following description in view of the drawings that show.

DETAILED DESCRIPTION OF THE INVENTION

In accordance with embodiments of the present invention, structural and/or operational relationships, as may be used to provide voltage scalability (e.g., to meet a desired voltage rating) in a switching array based on micro-electromechanical systems (MEMS) switches are described herein. Presently, MEMS generally refer to micron-scale structures that for example can integrate a multiplicity of functionally distinct elements, e.g., mechanical elements, electromechanical elements, sensors, actuators, and electronics, on a common substrate through micro-fabrication technology. It is contemplated, however, that many techniques and structures presently available in MEMS devices will in just a few years be available via nanotechnology-based devices, e.g., structures that may be smaller than 100 nanometers in size. Accordingly, even though example embodiments described throughout this document may refer to MEMS-based switching devices, it is submitted that the inventive aspects of the present invention should be broadly construed and should not be limited to micron-sized devices.

In the following detailed description, numerous specific details are set forth in order to provide a thorough understanding of various embodiments of the present invention. However, those skilled in the art will understand that embodiments of the present invention may be practiced without these specific details, that the present invention is not limited to the depicted embodiments, and that the present invention may be practiced in a variety of alternative embodiments. In other instances, well known methods, procedures, and components have not been described in detail.

Furthermore, various operations may be described as multiple discrete steps performed in a manner that is helpful for understanding embodiments of the present invention. However, the order of description should not be construed as to imply that these operations need be performed in the order they are presented, nor that they are even order dependent. Moreover, repeated usage of the phrase "in one embodiment" does not necessarily refer to the same embodiment, although it may. Lastly, the terms "comprising", "including", "having", and the like, as used in the present application, are intended to be synonymous unless otherwise indicated.

Figure 1:
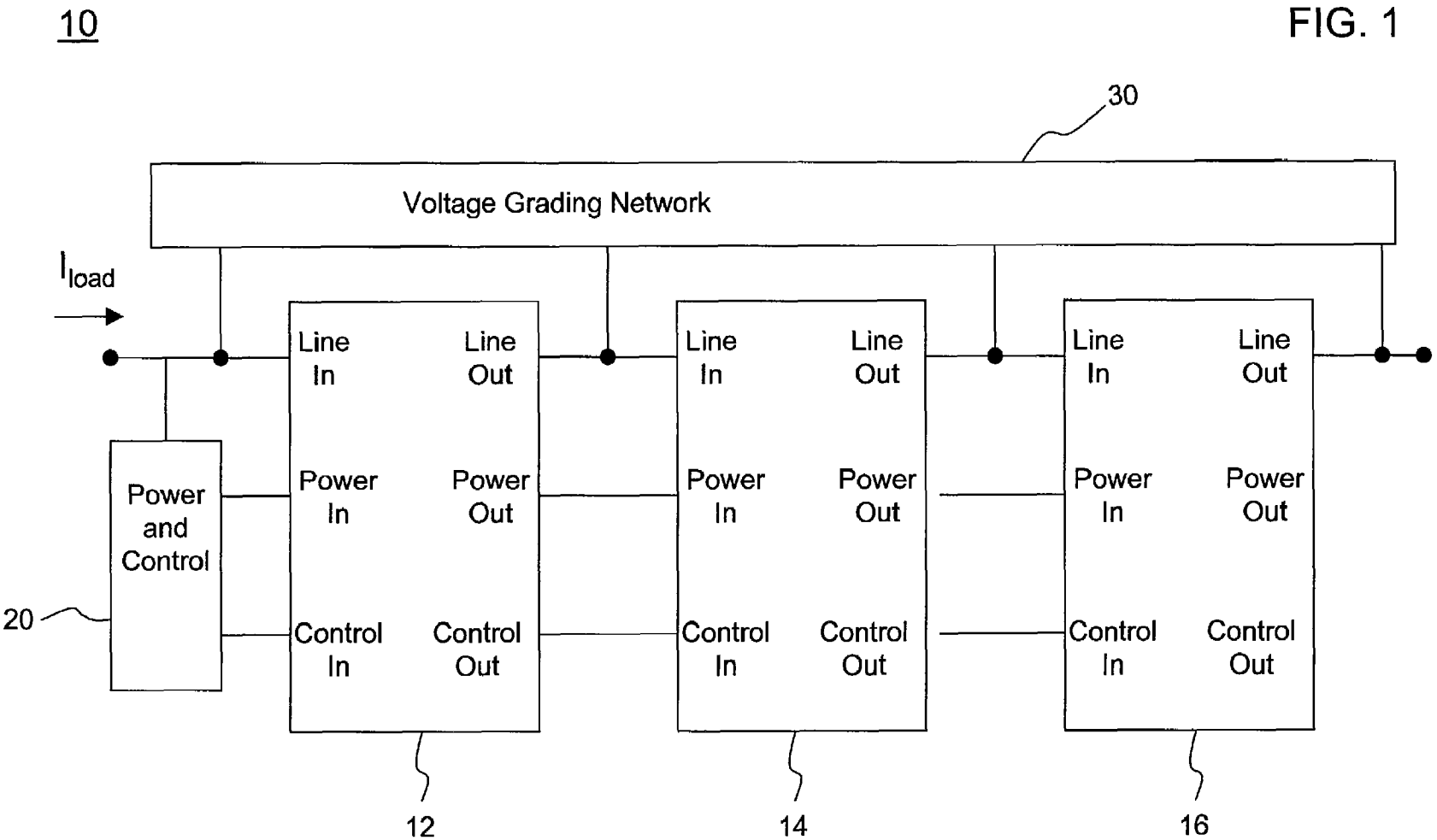
FIG. 1 is a block diagram of a plurality of MEMS-based switching modules as may be connected in a series circuit to achieve voltage scalability in accordance with aspects of the present invention.

FIG. 1 is a block diagram of a switching array 10 comprising a plurality of MEMS-based switching modules, such as switching modules 12, 14, 16 as may be connected in series circuit to achieve voltage scalability in accordance with aspects of the present invention. In one example embodiment, switching array 10 comprises a plurality of identical modules (e.g., used as building blocks of the switching array) with circuitry configured so that any number of modules can be connected in series to achieve a desired voltage rating (e.g., voltage scalability).

Each module 14, 16 of the array (other than a first module 12) has respective input terminals (Line In, Power In, and Control In) connected to the respective output terminals (Line Out, Power Out and Control Out)) of a precedent (e.g., previous) module in the series circuit. For example, terminals Line Out, Power Out and Control Out of module 12 are connected to terminals Line In, Power In, and Control In of the next module in the series circuit (e.g., module 14). Similarly, the terminals Line Out, Power Out and Control Out of module 14 are connected to terminals Line In, Power In, and Control In of the next module in the series circuit (e.g., module 16).

When each switching module of the array is set to a closed switching state, a current (e.g., $I_{load}$) flows, for example, from a first module of the series array (e.g., switching module 12 in FIG. 1) through any intermediate modules (e.g., switching module 14 in FIG. 1) and in turn to the last module of the series array (e.g., switching module 16 in FIG. 1) through each of the serially interconnected Line terminals. The terminals labeled Power are used to propagate power (such as may be used to power control circuitry in each respective switching module) from one end of the array to the other. The terminals labeled Control are used to propagate a desired on/off state for the switching modules of the series array.

Power and control may be applied to first module 12 of the series array from a power and control circuit 20 configured to provide appropriate power and control to first module 12. Power and control signals provided by circuit 20 are each electrically referenced to the respective terminal Line In of module 12. That is, circuit 20 supplies power to first module 12 of the series array by way of the input terminal labeled Power In at a suitable voltage level, which is electrically referenced to the input terminal labeled Line In. In case of a poly-phase system, such as a three-phase system the source of power could be provided through a respective resistor connected from the power supply to a respective one of the other phases of such a three phase system, or to neutral for a single phase system. Circuit 20 is also configured to selectively provide control as to whether each switching module should be set to an open state or to a closed state, and passes that information to first switching module 12 through the terminal labeled Control In.

When each switching module of the array is set to a respective open switching state, there is an open voltage that can develop across contacts 102 and 104 of a respective MEMS-based switching circuitry 106 (FIG. 2) therein. That is, across the terminals labeled Line In and Line Out in each respective switching module.

The inventors of the present invention have innovatively recognized circuitry that is configured to transfer (e.g., propagate) power supplied at each terminal pair Power In and Line In to each terminal pair Power Out and Line Out unaffected by the voltage that develops in the open switching state across terminals Line In and Line Out.

Figure 2:
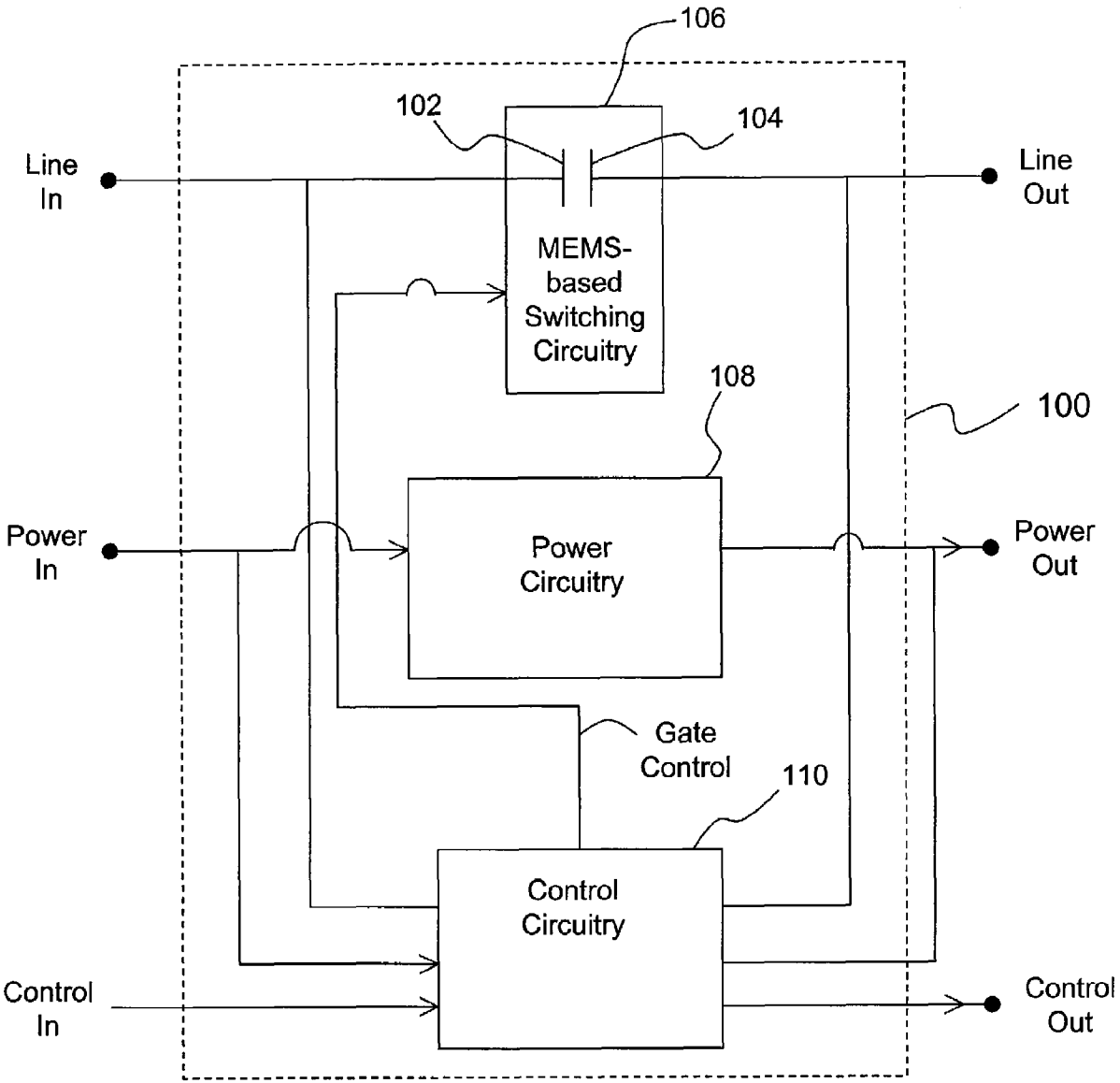
FIG. 2 is a block diagram illustrating circuitry details regarding one example embodiment of a switching module embodying aspects of the present invention.

FIG. 2 is a block diagram of one example embodiment of a MEMS-based switching module 100 as may be used to construct a switching array that may be connected in series circuit to achieve voltage scalability in accordance with aspects of the present invention. This example embodiment comprises three basic circuit assemblies: MEMS-based switching circuitry 106, a power circuitry 108, and a control circuitry 110.

Although in FIG. 2 switching circuitry 106 is shown as being made up of a single MEMS switch, it will be appreciated that switching circuitry 106 may comprise a plurality of parallel connected MEMS switches, such as comprising a number of parallel connected switches sufficient to achieve a desired current rating (i.e., current scalability). For the example embodiment shown in FIG. 2, a 3-terminal switch is shown. It will be appreciated, however, that it is readily feasible for one skilled in the art to build a module using 4-terminal switches. The signal labeled Gate Control as may be applied to a gate control terminal of switching circuitry 106 (more precisely the voltage level applied to the gate control terminal with respect to terminal Line In) determines whether each switch in switching circuitry 106 will be set to an open state or to a closed state.

The electrical power needs of each respective switching module are met by electrical power applied through input terminal Power In, referenced to input terminal Line In. For example, power may be supplied directly to power circuitry 108 (and control circuitry 110) through input terminal Power In. Power circuitry 108 is configured to provide output power through output terminal Power Out and this output power is appropriately adjusted (e.g., voltage level shifted) based on the amount of open voltage that develops across MEMS switching circuitry 106.

Control circuitry 110 may be configured to perform two basic functions. The first function is to perform any needed voltage level shifting between terminal Control In and the Gate Control signal applied to MEMS switching circuitry 106 to set a desired switching state, e.g., an open or a closed switching state. For switches whose gate control terminal is referenced to terminal Line In, this first function can be performed simply with just a line connection (e.g., through a wire) to pass the Gate Control signal to the respective gate control terminal. The second function is to provide an appropriate voltage level shifting of the module control signal to be passed to the next switching control module through terminal Control Out.

Figure 3:
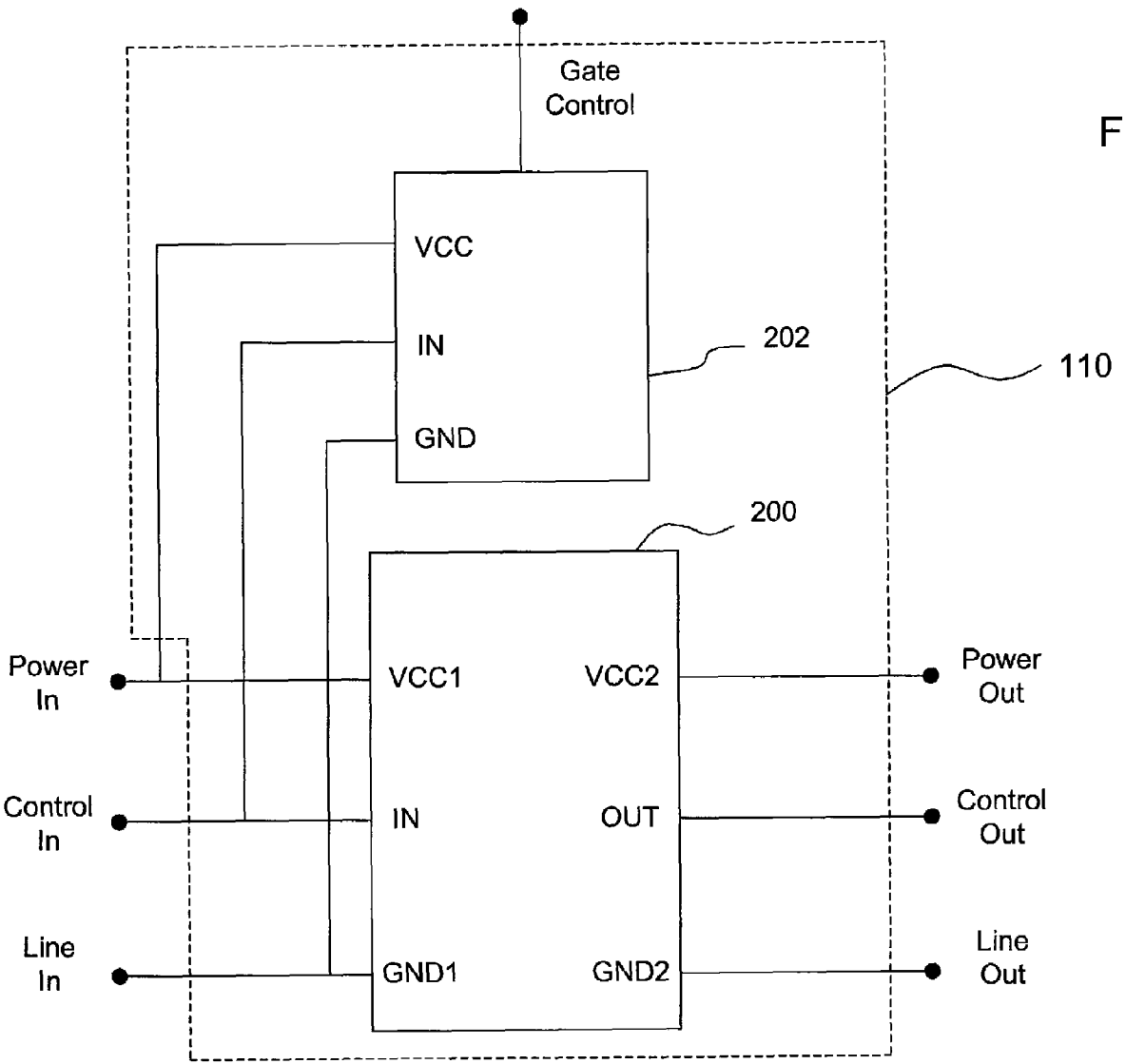
FIG. 3 is a block diagram regarding one example embodiment of control circuitry as may be used in a switching module embodying aspects of the present invention.

FIG. 3 is one example embodiment of one possible circuit implementation for control circuitry 110 using an opto-isolator device 200, such as a commercially available opto-isolator with pins labeled as shown, or any circuit that provides galvanic isolation to a module control signal applied to a respective switching module (e.g., galvanic isolation between the input and output terminals that propagate the module control signal). As seen in FIG. 3, terminal Line In is connected to provide a ground reference on the input side of opto-isolator 200, and terminal Line Out is connected to provide a ground reference on the output side of opto-isolator 200. Separate power supplies (e.g., connected via terminals Power In and Power Out) furnish separate power to each side of opto-isolator 200. A drive circuit 202 connected to terminal Power In and having a ground reference connected to the ground reference at the input side of opto-isolator 200 provides a local gate drive to the switching module. That is, drive circuit 202 supplies the Gate Control signal (referenced to terminal Line In) to the gate control terminal of MEMS switching circuitry 106 (FIG. 2).

Figure 4:
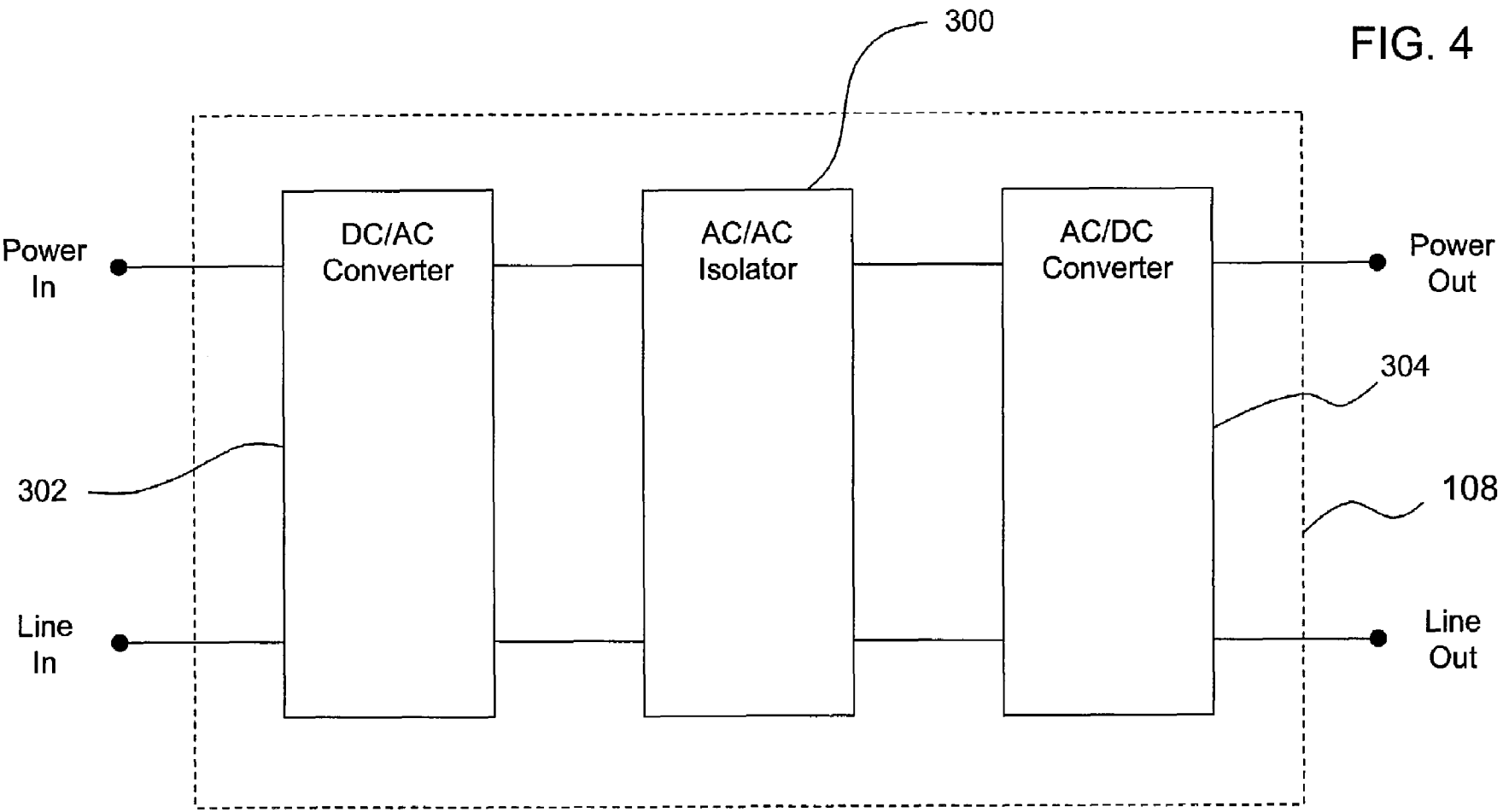
FIG. 4 is a block diagram regarding one example embodiment of power circuitry as may be used in a switching module embodying aspects of the present invention.

FIG. 4 is one example embodiment of one possible circuit implementation for power circuitry 108. Voltage isolation may be provided from a respective input side of a respective switching module to a respective output side of the switching module by an AC-to-AC isolator 300, such as a four-terminal piezoelectric isolator, or an AC transformer. The key point being that power is galvanically isolated, e.g., transferred across a galvanic gap between the input and the output sides. Since DC power is generally required for performing switching control, the voltage signals supplied through terminals Power In and Power Out commonly comprise respective DC signals. Accordingly, appropriate signal conditioners may be included, such as a DC-to-AC converter 302 connected at the input side and an AC-to-DC converter 304 connected at the output side. Power circuitry 108 allows transferring (e.g., propagating) electrical power supplied at terminal pair Power In and Line In to terminal pair Power Out and Line Out unaffected by the open voltage that can develop between terminal pair Line In and Line Out.

In operation, each switching module may be configured to perform the following example functions:

Monitoring a module control signal between Line In and Control In to control whether the MEMS-based switching circuitry (e.g., a plurality of parallel-connected switches) should be set to an open state or to a closed state.

Electrically referencing at least some of the circuitry in the respective switching module to Line In.

Applying a Gate Control signal to the respective MEMS-based switching circuitry therein referenced to Line In.

Obtaining its local power needs from Power In, referenced to Line In.

Using the open switch voltage, as may develop between Line In and Line Out of the MEMS-based switching circuitry, to provide an appropriate adjustment (e.g., voltage level shift) to the respective power and control signals, as such signals propagate from input to output to be supplied to the next switching module in the series. For example, the maximum (e.g., worst-case) voltage level shift may be required when the open switch voltage approximates the voltage rating of circuitry in the respective switching module.

Returning to FIG. 1, switching array 10 may preferably include a voltage grading network 30 to ensure approximately equal voltage distribution across each of the switching modules. Voltage grading network 30 may be desirable for the following reasons: There may be several current leakage paths that could otherwise unbalance the voltage distribution across each of the switching modules. Sources of leakage current may include resistive leakage currents within the MEMS switches, stray capacitive leakage currents, and the flow of power and control currents through the array. Furthermore, when transitioning to an open state, each serially connected switching module may not open at exactly the same instant in time. Voltage grading network 30 provides substantially equal voltage distribution by providing a through path for leakage currents and/or by delaying the onset of recovery voltage when the respective switches are set to an open state.

Figure 5:
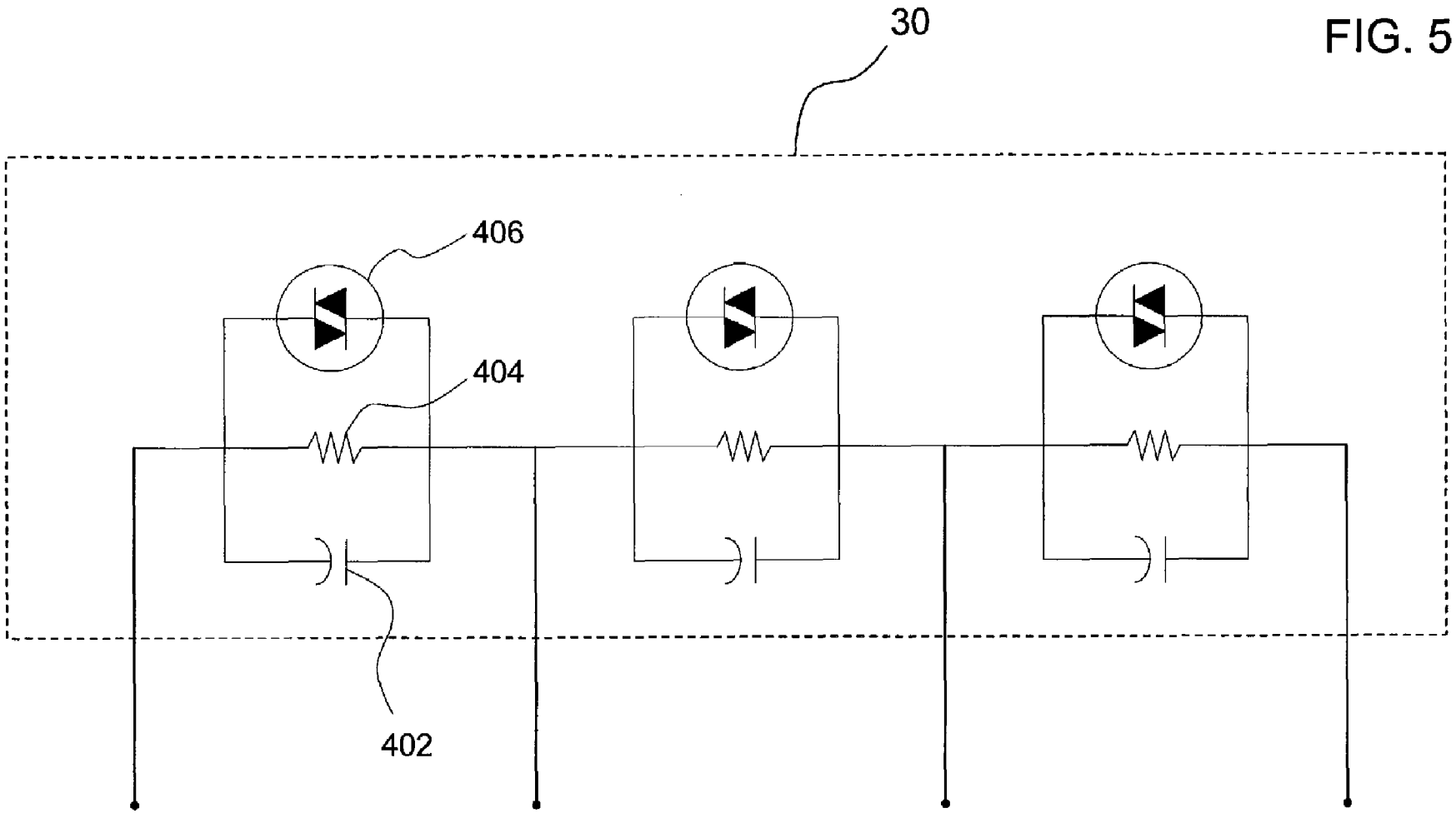
FIG. 5 is a block diagram of a voltage grading network as may be connected in parallel circuit to the switching modules of FIG. 1.

One example embodiment of grading network 30 is shown in FIG. 5 wherein a graded capacitor 402, a graded resistor 404, and an optional non-linear resistor 406 may be connected in parallel circuit with each module. Resistor 404 may be sized small enough to provide enough current to compensate for resistive leakage current and the return currents for the power and control circuitry circuits when the switches are set to an open state. Typical values may be on the order of 1 megaohms to 1000 megaohms. Capacitor 402 may be sized large enough to delay the onset of recovery voltage to span the timing scatter of the opening of the switches, e.g., in the order of 100 nanofarads. Non-linear resistor 406 (such as a zinc-oxide voltage clamp) may be provided to assure that the voltage rating of each module is not exceeded due to transient voltage surges from sources such as voltages induced in the system by nearby lightning strikes, etc.

While various embodiments of the present invention have been shown and described herein, it is noted that such embodiments are provided by way of example only. Numerous variations, changes and substitutions may be made without departing from the invention herein. Accordingly, it is intended that the invention be limited only by the spirit and scope of the appended claims.

The invention claimed is:

1. A system comprising at least one switching module comprising:

switching circuitry comprising at least one micro-electromechanical system switch for selectively establishing a current path from an input line to an output line of the switch in response to a gate control signal applied to the switch;

control circuitry coupled to the switching circuitry to supply the gate control signal to the micro-electromechanical system switch; and power circuitry coupled to the control circuitry and the switching circuitry, wherein the power circuitry comprises an input terminal pair and an output terminal pair galvanically isolated from one another, wherein a module power input signal received through the input terminal pair is electrically referenced to the input line of the switch, and a module power output signal supplied through the output terminal pair is electrically referenced to the output line of the switch so that the module output power signal is unaffected by a voltage that develops across the input and output lines of the micro-electromechanical system switch when said switch is set to an open state.

2. The system of claim 1, wherein the control circuitry comprises an input terminal pair and an output terminal pair galvanically isolated from one another, wherein a module control input signal received through the input terminal pair is electrically referenced to the input line of the switch, and a module control output signal supplied through the output terminal pair is electrically referenced to the output line of the switch so that the module control output signal is unaffected by the voltage that develops across the input and output lines of the micro-electromechanical system switch when said switch is set to an open state.

3. The system of claim 1, wherein the control circuitry comprises a drive circuit connected to receive the module control input signal electrically referenced to the input line of the switch to generate the gate control signal applied to the switch, wherein said gate control signal is electrically referenced to the input line of the switch.

4. The system of claim 2, comprising a plurality of switching modules coupled to one another in a series circuit, wherein a module power output signal from a respective switching module comprises a module power input signal to a next switching module in the series circuit.

5. The system of claim 4, wherein a module control output signal from said respective switching module comprises a module control input signal to the next switching module in the series circuit.

6. The system of claim 1, further comprising a grading resistor coupled in parallel circuit with the switching circuitry to provide a path to a resistive leakage current therein.

7. The system of claim 6, further comprising a grading capacitor coupled in parallel circuit with the switching circuitry to delay an onset of a transient recovery voltage.

8. The system of claim 7, further comprising a non-linear grading resistor coupled in parallel circuit with the switching circuitry to dissipate transient voltage surges.

9. The system of claim 1, wherein the switching circuitry comprises a plurality of micro-electromechanical switches coupled to one another in a parallel circuit.

10. A system comprising at least one switching module comprising:

switching circuitry comprising at least one micro-electromechanical system switch for selectively establishing a current path from an input line to an output line of the switch in response to a gate control signal applied to the switch;

control circuitry coupled to the switching circuitry to supply the gate control signal to the micro-electromechanical system switch, wherein the control circuitry comprises an input terminal pair and an output terminal pair galvanically isolated from one another, wherein a module control input signal received through the input terminal pair is electrically referenced to the input line of the switch, and a module control output signal supplied through the output terminal pair is electrically referenced to the output line of the switch so that the module control output signal is unaffected by a voltage that develops across the input and output lines of the micro-electromechanical system switch when said switch is set to an open state; and power circuitry coupled to the control circuitry and the switching circuitry, wherein the power circuitry is configured to propagate a module power signal unaffected by the voltage that develops across the input and output lines of the micro-electromechanical system switch when said switch is set to the open state.

11. The system of claim 10, wherein the control circuitry comprises a drive circuit connected to receive the module control input signal electrically referenced to the input line of the switch to generate the gate control signal applied to the switch, wherein said gate control signal is electrically referenced to the input line of the switch.

12. The system of claim 10, comprising a plurality of switching modules coupled to one another in a series circuit, wherein a module power output signal from a respective switching module comprises a module power input signal to a next switching module in the series circuit.

13. The system of claim 12, wherein a module control output signal from said respective switching module comprises a module control input signal to the next switching module in the series circuit.

14. The system of claim 10, further comprising a grading resistor coupled in parallel circuit with the switching circuitry to provide a path to a resistive leakage current therein.

15. The system of claim 14, further comprising a grading capacitor coupled in parallel circuit with the switching circuitry to delay an onset of a transient recovery voltage.

16. The system of claim 15, further comprising a non-linear grading resistor coupled in parallel circuit with the switching circuitry to dissipate transient voltage surges.

17. The system of claim 10, wherein the switching circuitry comprises a plurality of micro-electromechanical switches coupled to one another in a parallel circuit.

18. A system comprising a plurality of switching modules coupled to one another in a series circuit, each switching module comprising:

switching circuitry comprising at least one micro-electromechanical system switch for selectively establishing a current path from an input line to an output line of the switch in response to a gate control signal applied to the switch;

control circuitry coupled to the switching circuitry to supply the gate control signal to the micro-electromechanical system switch, wherein the control circuitry comprises an input terminal pair and an output terminal pair galvanically isolated from one another, wherein a module control input signal received through the input terminal pair is electrically referenced to the input line of the switch, and a module control output signal supplied through the output terminal pair is electrically referenced to the output line of the switch so that the module control output signal is unaffected by a voltage that develops across the input and output lines of the micro-electromechanical system switch when said switch is set to an open state, wherein a module control output signal from a respective switching module comprises a module control input signal to a next switching module in the series circuit;

power circuitry coupled to the control circuitry and the switching circuitry, wherein the power circuitry comprises an input terminal pair and an output terminal pair galvanically isolated from one another, wherein a module power input signal received through the input terminal pair is electrically referenced to the input line of the switch, and a module power output signal supplied through the output terminal pair is electrically referenced to the output line of the switch so that the module output power signal is unaffected by the voltage that develops across the input and output lines of the micro-electromechanical system switch when said switch is set to an open state, wherein a module power output signal from a respective switching module comprises a module power input signal to the next switching module in the series circuit; and a voltage grading network coupled in parallel circuit with the plurality of switching modules to provide a substantially equal voltage distribution across each of the plurality of switching modules.

* * * * *